US011456141B2

(12) United States Patent
Yoon

(10) Patent No.: US 11,456,141 B2
(45) Date of Patent: Sep. 27, 2022

(54) TEMPERATURE SENSITIVE PELLET TYPE THERMAL FUSE

(71) Applicant: DONG-YANG ELECTRONICS CO., LTD., Gwangju-si (KR)

(72) Inventor: Sung Woong Yoon, Seoul (KR)

(73) Assignee: DONG-YANG ELECTRONICS CO., LTD., Gwangju (KR)

( * ) Notice: Subject to any disclaimer, the term of this patent is extended or adjusted under 35 U.S.C. 154(b) by 219 days.

(21) Appl. No.: 16/612,861

(22) PCT Filed: Oct. 19, 2018

(86) PCT No.: PCT/KR2018/012441
§ 371 (c)(1),
(2) Date: Nov. 12, 2019

(87) PCT Pub. No.: WO2020/080584
PCT Pub. Date: Apr. 23, 2020

(65) Prior Publication Data
US 2021/0366680 A1 Nov. 25, 2021

(51) Int. Cl.
*H01H 85/143* (2006.01)
*H01H 85/041* (2006.01)
*H01H 85/165* (2006.01)

(52) U.S. Cl.
CPC ..... *H01H 85/143* (2013.01); *H01H 85/041* (2013.01); *H01H 85/165* (2013.01)

(58) Field of Classification Search
CPC .... H01H 85/04; H01H 85/143; H01H 85/041; H01H 85/165; H01H 37/76; H01H 37/761; H01H 2037/762
See application file for complete search history.

(56) References Cited

U.S. PATENT DOCUMENTS 3,274,361 A * 9/1966 Ebensteiner ..... H01H 37/765 337/148
3,944,960 A * 3/1976 Audette ..... H01H 37/765 337/408

(Continued)

FOREIGN PATENT DOCUMENTS

KR 10-2005-0040721 A 5/2005
KR 10-2009-0041082 A 4/2009

(Continued)

OTHER PUBLICATIONS

International Search Report for PCT/KR2018/012441 dated Jul. 18, 2019 [PCT/ISA/210].

*Primary Examiner* — Stephen S Sul
*Assistant Examiner* — Alexander Ryan Horton
(74) *Attorney, Agent, or Firm* — Sughrue Mion, PLLC

(57) ABSTRACT

A temperature-sensitive pellet type thermal fuse having a metal case (10); a first lead wire (L1) on an open end of the metal case (10) and insulated from the metal case (10); a second lead wire (L2) electrically connected to the bottom wall (12) of the metal case (10); a temperature-sensitive pellet (30) installed inside the case (10); a movable terminal (60) being in contact with the second lead wire (L2) and a fixed terminal (40) when below a fuse cutoff operation temperature, and being in contact with the metal case (10) but separated from the second lead wire (L2) when above the fuse cutoff operation temperature; the movable terminal (60) having a movable contact element (50) slidably contacting with the inner wall of a through hole (41) of the fixed terminal (40) to electrically connect to the fixed terminal (40).

4 Claims, 10 Drawing Sheets

(56) References Cited

U.S. PATENT DOCUMENTS

| | | | | | |
|---|---|---|---|---|---|
| 4,189,697 | A * | 2/1980 | Hara | H01H 37/765 | 337/407 |
| 4,276,532 | A * | 6/1981 | Aoki | H01H 37/765 | 337/407 |
| 4,281,308 | A * | 7/1981 | McVey | H01H 37/765 | 337/407 |
| 4,493,003 | A * | 1/1985 | Mickelson | H01T 1/14 | 361/119 |
| 9,460,883 | B2 * | 10/2016 | Yoshikawa | H01H 85/36 | |
| 2010/0219929 | A1 * | 9/2010 | Lee | H01H 37/765 | 337/182 |

FOREIGN PATENT DOCUMENTS

| | | | |
|---|---|---|---|
| KR | 10-2015-0125985 | A | 11/2015 |
| KR | 10-2016-0134492 | A | 11/2016 |
| KR | 10-2017-0056897 | A | 5/2017 |

* cited by examiner

TEMPERATURE SENSITIVE PELLET TYPE THERMAL FUSE

TECHNICAL FIELD

The present invention relates to a temperature sensitive pellet type thermal fuse, in particular, a temperature sensitive pellet type thermal fuse of which the pellet is melted to make the electric/electronic circuit of the device to be cut off, when the ambient or internal temperature of the device rises beyond the rated service temperature zone and reaches the dangerous temperature zone.

BACKGROUND ART

In household and industrial electronic/electrical devices, such as home appliances, mobile device, communication device, office device, device for an automobile, AC adapter, charger, electric motor, battery, etc., there is used a thermal fuse to protect the devices from damage caused by excessive heat.

Generally, a temperature sensitive pellet type thermal fuse is used for high level rated current rating. An example of conventional temperature-sensitive pellet type thermal fuses is disclosed in U.S. Pat. No. 4,189,697.

The conventional temperature sensitive pellet type thermal fuse disclosed in the US patent comprises: a cylindrical metal case (1) having an inner space, the inner space of which one end is blocked by a bottom and the other end is open; a first lead wire (2) connected to the bottom of the case (1); a second lead wire (3) fixed via an electrically insulating bush (4) at the open end of the case; a temperature pellet (9) of a predetermined height installed inside the case (1) in such a manner that the pellet (9) is biased towards the end (5) of the second lead wire (3) by a first spring (8) compressed on the bottom of the case (1) to be in contact with the end (5) of the second lead wire (3) and melts above a cutoff operation temperature higher than a normal temperature; a movable terminal (6); and a second spring (6b ) is compressively installed between a member (6a ) of the movable terminal (6) and the insulating bush (4).

In the above-mentioned conventional thermal fuse, the movable terminal (6) has a plurality of contact segments extending upwardly and outwardly from edge of a base portion, and edges of the contact segments are in contact with the inner wall of the case (1) to form a movable contact point.

As the temperature sensitive pellet is unevenly melted above a predetermined fuse cutoff operation temperature, the movable terminal (6) supported on the temperature sensitive pellet is tilted. Thus, when the movable terminal moves tilted in the case, the contact segments of the movable terminal may be caught by the inner wall of the case. This causes the fuse to fail to carry out a fuse cutoff operation even when the inner temperature of the fuse reaches a fuse cutoff operation temperature.

DISCLOSURE

Problem to be Solved

An object of the present invention is to provide a temperature sensitive pellet type thermal fuse of which the movable terminal is capable of operating stably at the temperature condition of the cutoff operation of fuse, regardless of the status of melting the pellet, for example, unevenly melting of the pellet.

Technical Solution

To accomplish the object described above, a temperature sensitive pellet type thermal fuse of the present invention comprises a metal case having an open end and a bottom wall of the metal case at an opposite end;

a first lead wire connected to the bottom wall of the metal case to electrically connect to the metal case;

a second lead wire fixed to the open end of the metal case so as to be insulated from the metal case by an insulating bush and having a fixed contact point on an end placed inside the insulating bush;

a temperature sensitive pellet installed in the metal case in such a manner that the temperature sensitive pellet maintains a predetermined height below a fuse cutoff operation temperature and melts above the fuse cutoff operation temperature;

a movable terminal movably installed in the metal case and operating in such a manner that below the fuse cutoff operation temperature, the movable terminal being in contact with the fixed contact point of the second lead wire and spontaneously with a fixed terminal to electrically connect the second lead wire with the case, and above the fuse cutoff operation temperature, the movable terminal being in contact with the case but separated from the fixed contact point of the second lead wire to electrically disconnect the second lead wire from the metal case;

a first spring biasing the movable terminal so as to render the movable terminal in contact with the second lead wire below the fuse cutoff operation temperature;

a second spring pressing the movable terminal in a direction to separate the movable terminal from the second lead wire; and the fixed terminal having a ring shape and a through hole with an inner wall of the through hole, the fixed terminal being fixed on an inner wall of the metal case so as to be electrically connected to the metal case, wherein the movable terminal has a movable contact element at a lower end, the movable contact element slidably contacting with the inner wall of the through hole of the fixed terminal to electrically connect to the fixed terminal and having a bottom of the movable contact element attached to the lower end of the movable terminal and a movable contact plate, the movable contact plate obliquely extended upwardly from a circumferential edge of the bottom of the movable contact element and slidably contacting with an edge of the inner wall of the through hole of the fixed terminal to form a movable contacts on an outer surface thereof.

According to one aspect of the present invention, the movable contact plate has an upper end of which the diameter is configured to be smaller the inner diameter of the case and larger than the diameter of the through hole of the fixed terminal so as to be in non-contact with the inner wall of the case.

By the construction as mentioned above, when the movable terminal moves in the case for a fuse cutoff operation, the movable contact plate can stably move in a state of sliding contact only with the edge of the through hole of the fixed terminal without interference with the inner wall of the case.

In another aspect of the present invention, the movable contact plate may be divided into a plurality of segments, each of which is spaced to each other along the circumferential edge of the bottom.

In still another aspect of the present invention, the temperature sensitive pellet is arranged between the bottom of the movable contact element and the inner surface of the bottom wall of the metal case and supported by the first spring compressed on the inner bottom of the case.

In still another aspect of the invention, a top plate is disposed between the movable contact element and the top surface of the temperature sensitive pellet in such a manner that the movable contact element can be supported on the top plate. A bottom plate is disposed between the bottom surface of the temperature sensitive pellet and the upper end portion of the first spring in such a manner that the temperature sensitive pellet can be stably supported on the upper end portion of the first spring.

According to the above-mentioned aspect of the invention, even when the temperature sensitive pellet melts unevenly, the top plate stably supports the movable contact element.

In still another aspect of the invention, the fixed contact point where the movable terminal contacts with the second lead wire locates in a bore of the insulating bush. This can block a spark which may occur at the fixed contact point. The second spring is installed in the bore of the insulating bush and surrounded by the inner wall. This can prevent from buckling of the second spring.

Advantageous Effects

According to the present invention, even though key parts such as a case, a movable contact element, etc., have dimensional defect or non-uniform size, an exact fuse-cutoff operation can be made without malfunction of the movable contact element.

As allowable range of dimensional size is wider, defect rates of made parts and assembly can be reduced.

MODE OF INVENTION

Hereafter, a preferable embodiment of the present invention will be described in detail with reference to the accompanying drawings.

In the description of the present invention, the terms indicating directions or position, such as 'upper' and 'lower' are used only for explanation, and are not to limit the scope of the invention.

Figure 1:
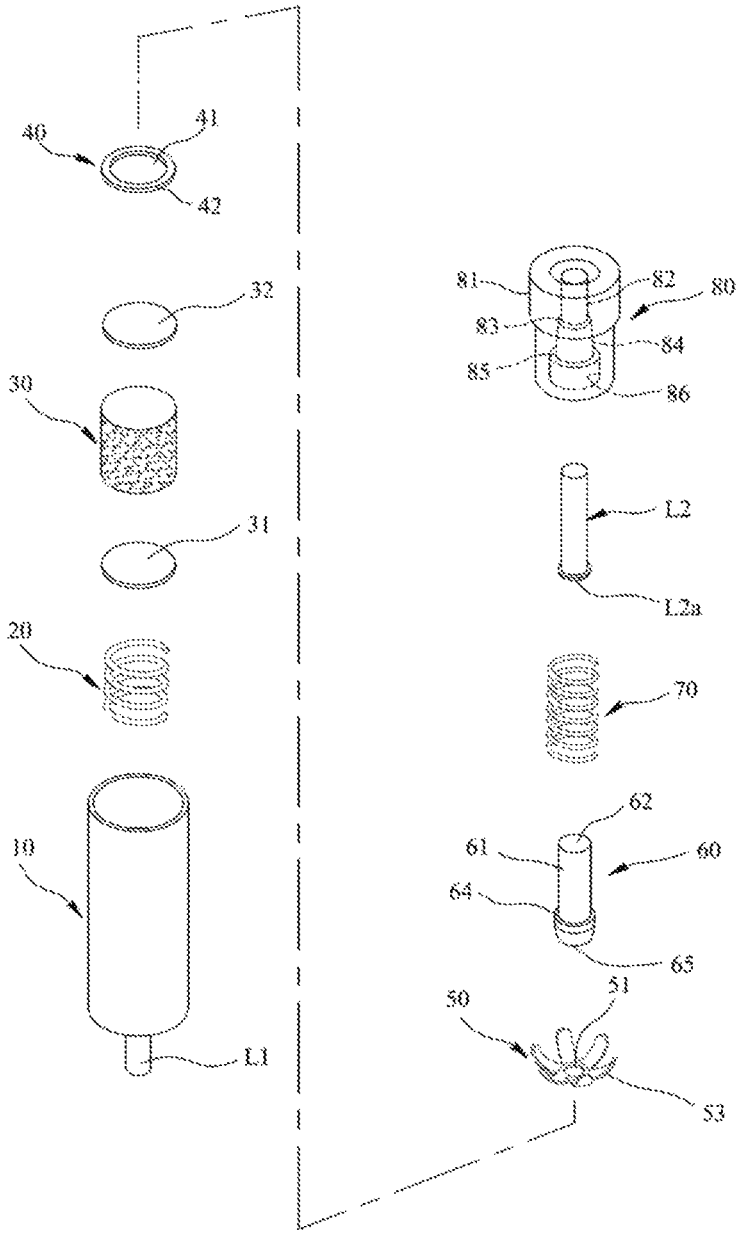
FIG. 1 illustrates an exploded view of the thermal fuse according to the present invention.
Figure 2:
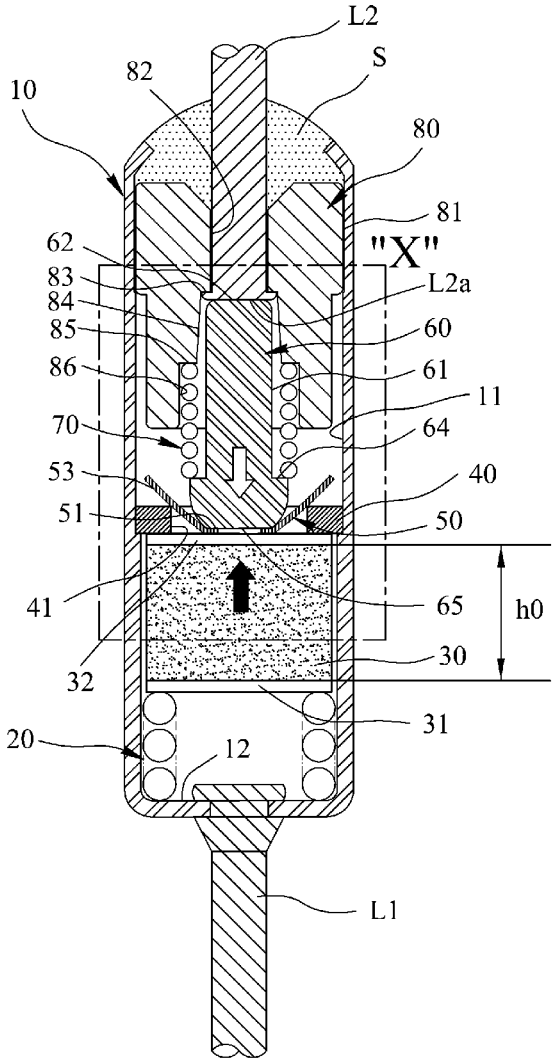
FIG. 2 illustrates a longitudinally sectional view of the thermal fuse in a normal state of fuse non-cutoff below a fuse cutoff operation temperature.
Figure 2A:
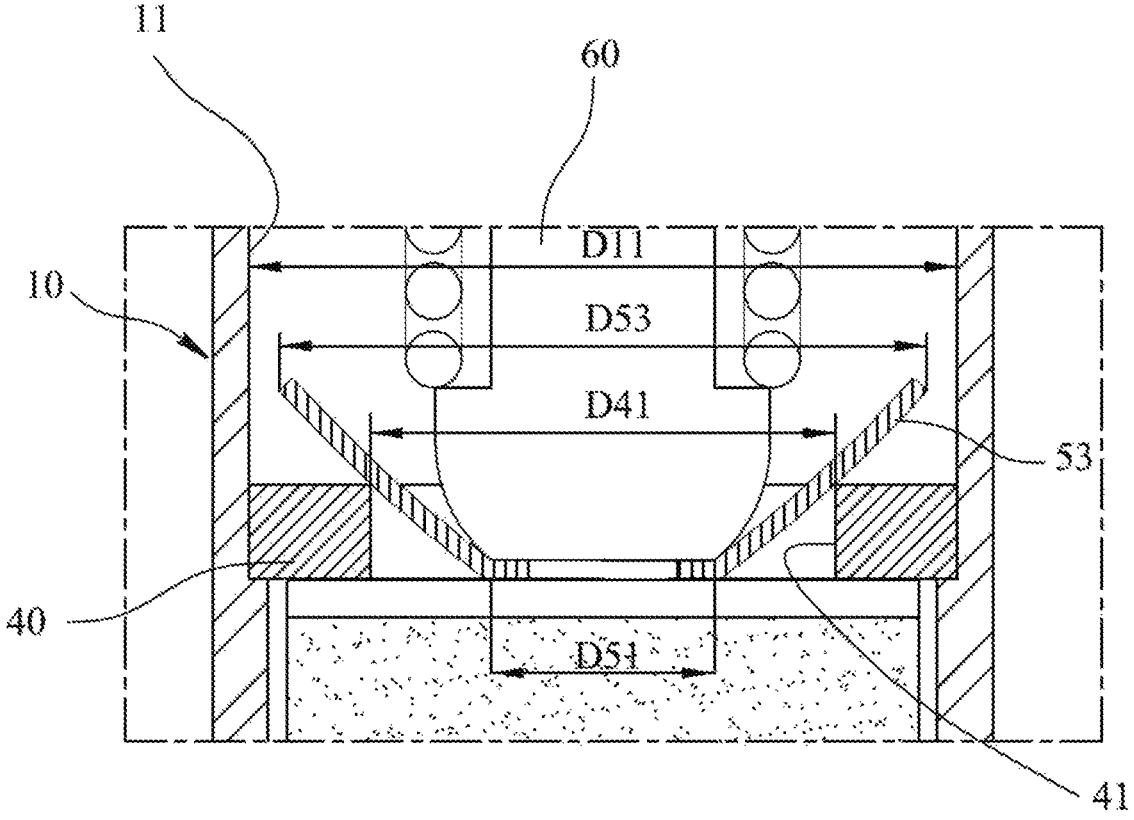
FIG. 2A illustrates an enlarged view of "X" portion of FIG. 2, showing a structural relationship between the movable terminal and the fixed terminal.
Figure 3:
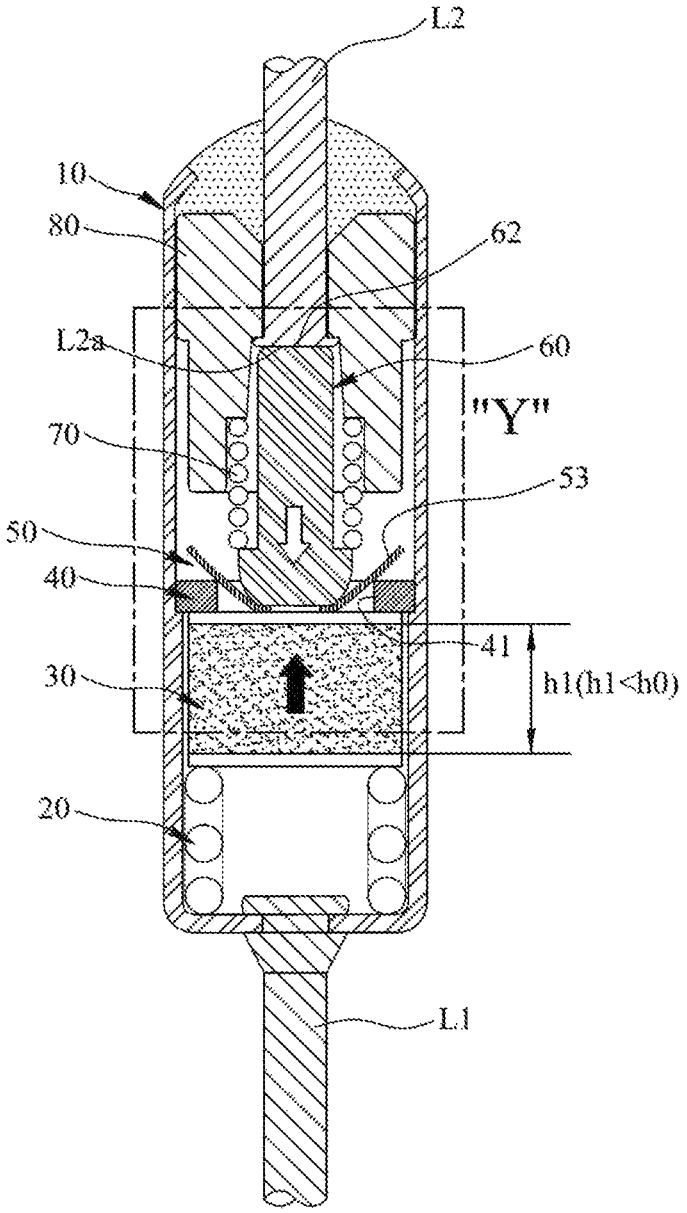
FIG. 3 illustrates a longitudinally sectional view of the thermal fuse in the state just before a fuse cutoff operation (when the height of the pellet is 'h1')
Figure 4:
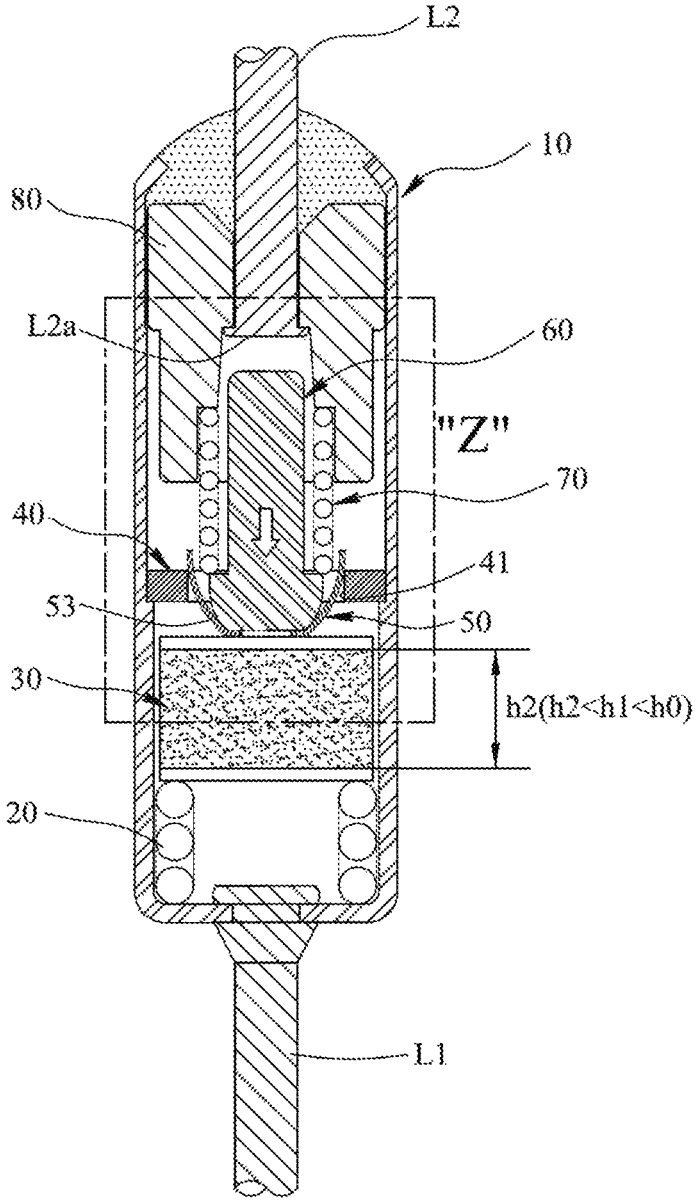
FIG. 4 illustrates a longitudinally sectional view of the thermal fuse in the state of a fuse cutoff operation.

As shown in FIGS. 1 and 2, a temperature-sensitive pellet type thermal fuse according to an embodiment of the present invention comprises a cylindrical case (10) made of metal, which has an open end at one end and a bottom wall (12) at the other end.

A first lead wire (L1) is connected to the bottom wall (12). A second lead wire (L2) is inserted through an insulating bush (80) into the open end of the case (10) and has a fixed contact point (L2*a*) on a head portion located in the insulating bush (80). The insulating bush (80) is made of non-conductive material, preferably ceramic, and is inserted and fixed in the open end of the case (10) so as to electrically insulate the second lead wire (L2) from the case (10). The insulating bush (80) has a though hole (82), an upper bore (84) and a lower bore (86) of larger diameter than that of the upper bore. The upper bore (84) has a diameter larger than that of the through hole (82) to form an upper shoulder (83) where the head portion is seated. The lower bore (86) has a diameter larger than that of the upper bore (84) to form a spring seat (85) where one end of a second spring (70), which will be explained later, is seated.

The second lead wire (L2) is inserted into the insulating bush (80) through the through hole (82) in such a manner that the head portion of the second wire (L2) is seated on the upper shoulder (83) in the insulating bush (80). The open end outside of the insulating bush (80) is sealed with sealing material (S).

Accordingly, as the fixed contact point (L2*a*) is located inside of the insulating bush (80) and enclosed by inner wall of the upper bore (84) of the insulating bush (80), the insulating bush (80) can block a spark which may happen on the fixed contact point (L2*a*) so that the spark may not come out of the case. Unexplained symbol '81' in FIG. 2 indicates an outer surface of the insulating bush (80).

As shown in FIG. 2, below the insulating bush (80), a fixed terminal (40) of a ring shape is installed in the case (10). The fixed terminal (40) has a through hole (41) with an inner wall and is retained on an inner wall (11) of the case (10) to be electrically connected to the case (10). Preferably, as shown in FIG. 2, the fixed terminal (40) is seated on and retained to a shoulder formed on the inner wall (11) of the case (10). The fixed terminal (40) may be retained on the shoulder, preferably with using soldering.

A movable terminal (60) is installed movably between the head portion of the second lead wire (L2) and the fixed terminal (40). The movable terminal (60) has an upper contact portion (62) at an upper end and a movable contact element (50) at a lower end (65).

Below a predetermined temperature before a fuse cutoff operation, the upper contact portion (62) of the movable terminal (60) is in contact with the fixed contact point (L2*a*) of the second lead wire (L2), and the movable contact element (50) provided at the lower end (65) is spontaneously in contact with an edge of inner wall (41) of the fixed terminal (40), but not with the inner wall (11) of the case (10).

Above the fuse cutoff operation temperature, the movable terminal (60) operates in such a manner that the movable contact element (50) at the lower end (65) keeps in contact with the edge of inner wall (41) of the fixed terminal (40), not with the inner wall (11) of the case (10), but the upper contact portion (62) of body (61) separates from the fixed contact point (L2*a*) of the second lead wire (L2) to electrically cutoff the second lead wire (L2) from the case (10).

The movable terminal (60) has a spring seat (64) at the lower end (65) thereof. The second spring (70) is compressively mounted between the spring seat (85) of the insulating bush (80) and a spring seat (64) of the movable terminal (60) to press the movable terminal (60) toward the fixed terminal (40).

The movable terminal (60) comprises a movable contact element (50) at the lower end (65). The movable contact element (50) has a movable contact plate (53) slidably contacting with the edge of the inner wall (41) of the fixed terminal (40) to form movable contact point on the outer surface.

Figure 6:
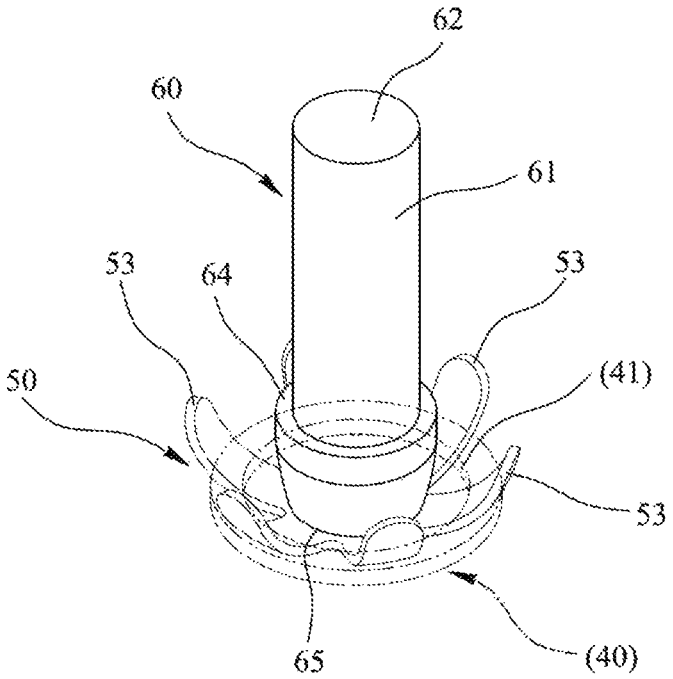
FIG. 6 illustrates a perspective view showing structural relationship between the movable terminal and the fixed terminal to form a movable contact point in the thermal fuse according to the present invention.
Figure 7:
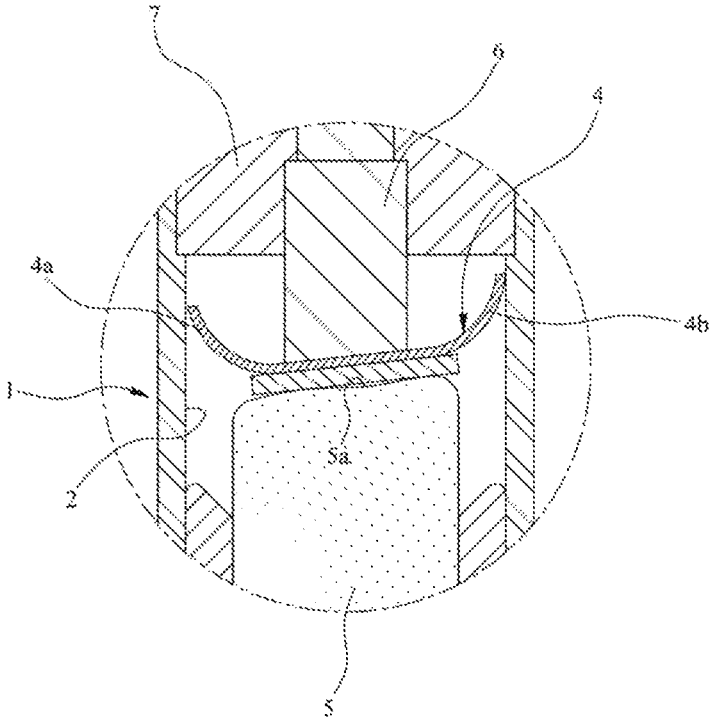
Fig. 7 (Prior Art)
FIG. 7 illustrates a partially enlarged view of a conventional thermal fuse in a state that a movable contact element is tilted in the case.

As shown in FIGS. 1, 2 and 6, the movable contact plate (53) is attached on the bottom surface of the lower end (65) of the movable terminal (60). The movable contact plate (53) is obliquely extended upwardly from a circumferential edge of the bottom (51) and slidably contacts with an edge of the inner wall (41) of the through hole (41) of the fixed terminal (40) to form movable contacts on the outer surface thereof.

As shown in FIGS. 1 and 6, the movable contact plate (53) is divided into a plurality of segments. The segments are apart from each other in a distance along the circumference. However, the movable contact plate (53) is limited to this shape and may be a cup-shape.

To form the above-mentioned structure of contact between the movable terminal (60) and the fixed terminal (40), the largest diameter (D53) at the upper end of the movable contact plate (53) should be smaller than the inner diameter (D11) of the case (10) and be larger than a diameter (D41) of the through hole (41) of the fixed terminal (40). The smallest diameter (D51) at the bottom (51) of the movable contact plate (53) should be smaller than the diameter (D41) of the through hole (41) of the fixed terminal (40).

When doing a fuse cutoff operation, the lower end of the movable contact plate (53) can stably move downwardly through the through hole (41) of the fixed terminal (40) without interference with the inner wall (11) of the case (10).

Figure 5:
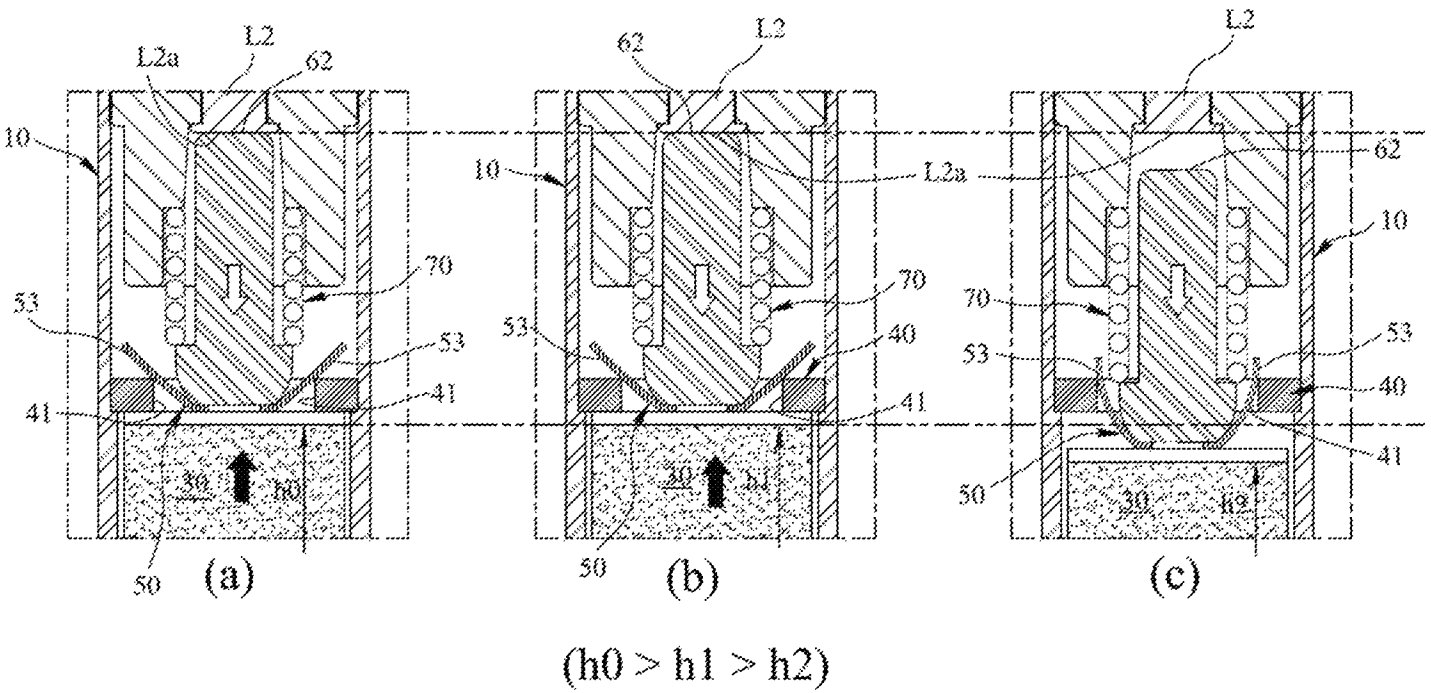
FIG. 5 illustrates enlarged sectional views of the sequential steps of the fuse cutoff operation of the thermal fuse: the figure (a) shows a partially enlarged sectional view of "X" portion of FIG. 2, the figure (b) shows a partially enlarged sectional view of "Y" portion of FIG. 3, and the figure (c) shows a partially enlarged sectional view of "Z" portion of FIG. 4.

At the side of bottom in the case, a temperature sensitive pellet (30) is formed with temperature sensitive material powder. The temperature sensitive pellet maintains the initial pellet shape of a predetermined initial height (h0) until arriving at a fuse cutoff operation temperature as shown in FIGS. 5(*a*) and 5(*b*).

The temperature sensitive pellet (30) is biased by a first spring (20) in the direction (the direction of the black arrow) toward the bottom surface of the movable contact plate (53) to support the bottom surface of the movable contact plate (53).

A bottom plate (31) may be interposed between the bottom surface of the temperature sensitive pellet (30) and the upper end portion of the first spring (20), and a top plate (32) may be disposed on the top surface of the temperature sensitive pellet (30) to support the bottom surface of the movable contact plate (53). In this embodiment, the spring force of the first spring (20) exerts evenly over the whole bottom surface of the temperature sensitive pellet (30) and thus can support the movable contact plate (53) horizontally, without tilting.

When the internal or ambient temperature of the temperature sensitive fuse is below the fuse cutoff operation temperature, the height of the temperature sensitive pellet (30) does not decrease so that the spring force of the first spring (20) does not decrease. Under this condition as shown in FIGS. 5(*a*) and 5(*b*), the movable terminal (60) keeps in contact with the second lead wire (L2) at the fixed contact point (L2*a*) while the movable terminal (60) keeps in sliding contact with the fixed terminal (40) on the outer surface of the movable contact plate (53). Accordingly, the temperature sensitive fuse makes an electrical connection between the first lead wire (L1) and the second lead wire (L2) through the following current carrying path: the second lead wire (L2) →the movable terminal (60)→the movable contact plate (53)→the fixed terminal (40)→the case (10)→the first lead wire (L1).

When the internal or ambient temperature of the temperature sensitive fuse is above the fuse cutoff operation temperature, the temperature sensitive pellet (30) melts and thus the height of the temperature sensitive pellet (30) decreased to the height of 'h2' (h2<h1) as shown in FIGS. 5(*b*) and 5(*c*). In this case, the spring force (white arrow) of the first spring (20) acting on the bottom surface of the moving terminal (60) in the direction of the black arrow through the temperature sensitive pellet (30) is weaker than that of the spring force of the second spring (70) acting on the movable terminal in the direction of the white arrow. Accordingly, the movable terminal (60) moves downwardly in the direction of the white arrow and separates the upper contact portion (62) from the fixed contact point (L2*a*) to electrically disconnect the first lead wire (L1) from the second lead wire (L2), that is, to make 'fuse cutoff operation'.

As shown in FIG. 5(*c*), when carrying out a fuse cutoff operation, the movable contact plate (53) of the movable terminal (60) moves downwardly through the through hole (41) in a state of sliding contact only with the edge of the inner wall of the through hole (41) of the fixed terminal (40) without interference with the inner wall (11) of the case (10) and thus the fuse carries out the fuse cutoff operation.

Figure 8:
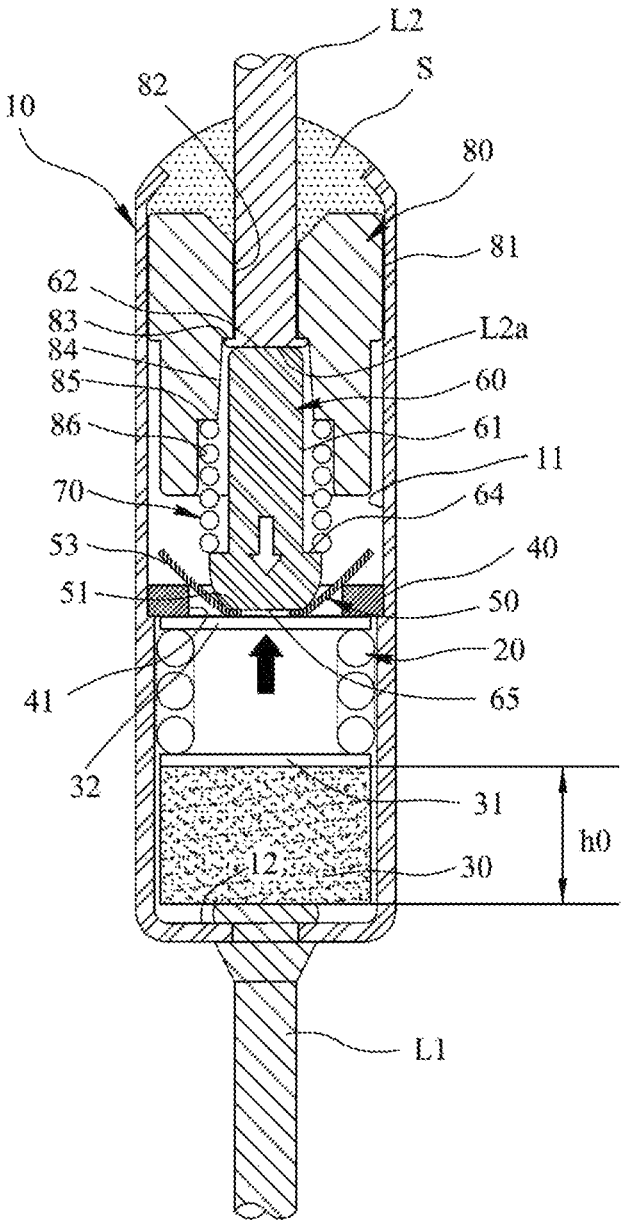
FIG. 8 illustrates a longitudinally sectional view of another embodiment of the present invention, in a state before fuse cutoff operation.
Figure 9:
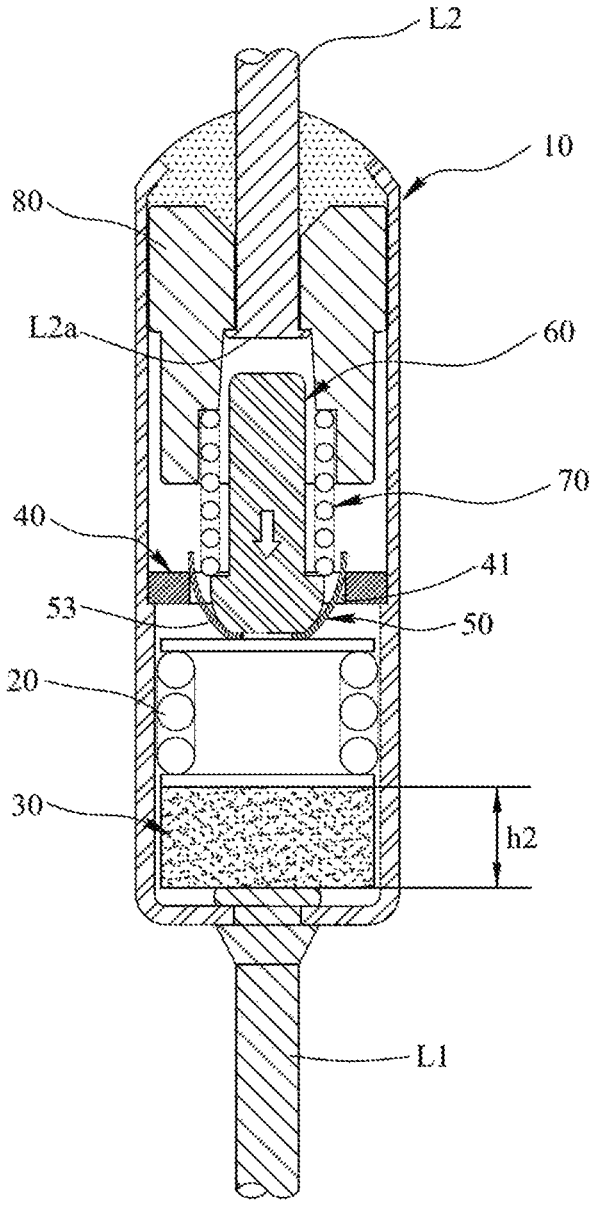
FIG. 9 illustrates a longitudinally sectional view of another embodiment of the present invention, in a state of fuse cutoff.

FIGS. 8 and 9 illustrate another embodiment of the present invention. In the embodiment, the temperature sensitive pellet (30) is installed on the bottom of the case (10). A bottom plate (32) is placed on the top surface of the temperature sensitive pellet (30). The first spring (20) is compressively installed between a top plate (32) on the upper end of the first spring (20) and the bottom plate (32) to support the bottom of the movable contact plate (53). The operation of the temperature sensitive pellet and the first spring is the same as that of the proceeding embodiment as explained. Thus, detailed description of the operation will be omitted.

DESCRIPTION OF SYMBOLS

10: case
11: inner wall
D11: inner diameter of the case
12: bottom wall
20: first spring
L1: first lead wire
L2: second lead wire
L2*a*: fixed contact point
S: sealing material
30: temperature sensitive pellet

31: bottom plate
32: top plate
40: fixed terminal
41: through hole
D41: diameter of the through hole
50: movable contact element
51: bottom
D51: diameter of the bottom
53: movable contact plate
60: movable terminal
61: body of movable terminal
62: upper contact portion
64: spring seat
65: lower end of the movable terminal
70: second spring
80: insulating bush
82: through hole
83: upper shoulder
84: upper bore
85: spring seat
86: lower bore

What is claimed is:

1. A temperature sensitive pellet type thermal fuse comprises:

a metal case (10) having an open end and a bottom wall (12) of the metal case (10) at an opposite end;

a first lead wire (L1) connected to the bottom wall (12) of the metal case (10) to electrically connect to the case (10);

a second lead wire (L2) fixed to the open end of the metal case (10) so as to be insulated from the metal case (10) by an insulating bush (80) and having a fixed contact point (L2*a*) on an end placed inside the insulating bush (80);

a temperature sensitive pellet (30) installed in the metal case (10) in such a manner that the temperature sensitive pellet (30) maintains a predetermined height (h0) below a fuse cutoff operation temperature and melts above the fuse cutoff operation temperature;

a movable terminal (60) movably installed in the metal case (10) and operating in such a manner that below the fuse cutoff operation temperature, the movable terminal (60) being in contact with the fixed contact point (L2*a*) of the second lead wire (L2) and spontaneously with a fixed terminal (40) to electrically connect the second lead wire (L2) with the metal case (10), and above the fuse cutoff operation temperature, the movable terminal (60) being in contact with the metal case (10) but separated from the fixed contact point (L2*a*) of the second lead wire (L2) to electrically disconnect the second lead wire (L2) from the case (10);

a first spring (20) biasing the movable terminal (60) so as to render the movable terminal (60) in contact with the second lead wire (L2) below the fuse cutoff operation temperature;

a second spring (70) biasing the movable terminal (60) in a direction to separate the movable terminal (60) from the second lead wire (L2); and the fixed terminal (40) having a through hole (41) with an inner wall of the through hole (41), the fixed terminal (40) being fixed on an inner wall (11) of the metal case (10) so as to be electrically connected to the metal case (10), wherein the movable terminal (60) has a movable contact element (50) at a lower end (65), the movable contact element (50) slidably contacting with the inner wall of the through hole (41) of the fixed terminal (40) to electrically connect to the fixed terminal (40) and having a bottom (51) of the movable contact element attached to the lower end (65) of the movable terminal (60) and a movable contact plate (53), the movable contact plate (53) obliquely extended upwardly from a circumferential edge of the bottom (51) of the movable contact element and slidably contacting with an edge of the inner wall of the through hole (41) of the fixed terminal (40) to form a movable contact point on an outer surface thereof, wherein a largest diameter (D53) at an upper end of the movable contact plate (53) is configured to be smaller than an inner diameter (D11) of the metal case (10) and larger than a diameter (D41) of the through hole (41) of the fixed terminal (40), and a smallest diameter (D51) at the bottom (51) of the movable contact element being configured to be smaller than the diameter (D41) of the through hole (41) of the fixed terminal (40).

2. The temperature sensitive pellet type thermal fuse of claim 1, wherein the movable contact plate (53) is divided into a plurality of segments, each of the segments being spaced to each other along the circumferential edge of the bottom (51).

3. The temperature sensitive pellet type thermal fuse of claim 1, wherein the temperature sensitive pellet (30) is mounted on the bottom wall (12) of the metal case (10), a bottom plate (31) being interposed between an upper end of the first spring (20) and a bottom surface of the temperature sensitive pellet (30), and a top plate (32) being arranged on a top surface of the temperature sensitive pellet (30).

4. The temperature sensitive pellet type thermal fuse of claim 1, wherein the temperature sensitive pellet (30) is installed on the bottom wall (12) of the metal case (10), a bottom plate (31) being placed on a top surface of the temperature sensitive pellet (30), and the first spring (20) being compressively installed between a top plate (32) on an upper end of the first spring (20) and the bottom plate (31) to support the bottom (51) of the movable contact element.

* * * * *